US006164453A

United States Patent [19]

Perkins

[11] Patent Number: 6,164,453

[45] **Date of Patent: *Dec. 26, 2000**

[54] BULK CONTAINER

[75] Inventor: David W. Perkins, Hiawatha, Iowa

[73] Assignee: Paper Systems, Inc., Des Moines, Iowa

[ * ] Notice: This patent is subject to a terminal disclaimer.

[21] Appl. No.: 09/397,215

[22] Filed: Sep. 16, 1999

Related U.S. Application Data

[63] Continuation-in-part of application No. 09/132,190, Aug. 11, 1998, Pat. No. 6,000,549.

[51] Int. Cl.[7] ..... B65D 81/02

[52] U.S. Cl. ..... 206/596; 206/600; 220/495.03; 220/666; 229/117.27

[58] Field of Search ..... 206/386, 503, 206/320, 326, 596, 597, 599, 600; 220/1.6, 495.03, 495.05, 495.06, 23.91, 315, 666, 459.01; 229/117.3, 117.35, 117.27

[56] References Cited

U.S. PATENT DOCUMENTS 3,529,717 9/1970 McDougal .
3,896,991 7/1975 Kozlowski et al. .
4,054,223 10/1977 Marques .
4,359,182 11/1982 Perkins, Jr. .
4,392,607 7/1983 Perkins, Jr. .
4,421,253 12/1983 Croley .
4,614,277 9/1986 Fourie et al. .
4,850,506 7/1989 Heaps, Jr. et al. .
4,901,885 2/1990 Boots .
4,903,859 2/1990 Derby et al. .
5,069,338 12/1991 Grigsby .
5,069,359 12/1991 Liebel .
5,188,460 2/1993 Dorse .
5,348,186 9/1994 Baker .
5,353,982 10/1994 Perkins et al. .
5,562,229 10/1996 Callahan .
5,813,562 9/1998 Perkins .

*Primary Examiner*—Paul T. Sewell
*Assistant Examiner*—Nhan T. Lam
*Attorney, Agent, or Firm*—Zarley, McKee, Thomte, Voorhees & Sease

[57] ABSTRACT

A bulk container for flowable materials includes flexible inner and outer tubular members. The lower edge of the outer member and the lower edge of the inner member are joined together along a bottom peripheral seam. Vertical support members are inserted into a plurality of pockets around the container so that the container is automatically self-stabilizing.

30 Claims, 2 Drawing Sheets

BULK CONTAINER

CROSS-REFERENCE TO RELATED APPLICATION(S)

This application is a continuation-in-part of U.S. patent application Ser. No. 09/132,190 filed Aug. 11, 1998, now U.S. Pat. No. 6,000,549.

BACKGROUND OF THE INVENTION

The present invention relates to bulk containers for flowable materials including, but not limited to, fluids. More particularly, this invention relates to a unique flexible bulk container system that is stackable both in use and in storage and is collapsible to facilitate more compact storage.

Handling flowable or fluent materials in bulk is difficult because of the weight of the material and the bulk of the container. Warehouse and in-transit storage space is often scarce and expensive. Various containers have been developed to address this handling problem. For instance, many existing container systems utilize a rigid frame, a drum, or a rigid frame with a flexible, fluid impervious liner. Some of these rigid containers can even be stacked to save space. However, these container systems are bulky, requiring considerable storage space whether they are full or empty. Such container systems are also quite heavy, whether full or empty. In an effort to reduce weight and cost, some container manufacturers have tried corrugated cardboard container walls, but the cardboard walls are not strong enough to withstand the high compression loads of stacking. Furthermore, the cardboard deteriorates if exposed to moisture.

Therefore, a primary objective of the present invention is the provision of an improved bulk container system.

Another objective of this invention is the provision of a container system that is collapsible when not in use.

Another objective of this invention is the provision of a container system with an outer body or frame that includes some flexible side walls and some rigid or semi-rigid side walls, such that the outer body foldingly collapses for storage.

Another objective of this invention is the provision of a container system that can be stored on or incorporated with a standard wooden shipping pallet.

Another objective of this invention is the provision of a container system that is lightweight, strong, waterproof, durable and yet stackable.

Another objective of this invention is the provision of a container system that utilizes rigid support walls or support members removably disposed in pockets in some, but not all, sides the outer body.

Another objective of this invention is the provision of a container system that is shaped like an octagon in a horizontal plane so as to allow a relatively large volume of material to be stored in a given space, utilizing a round of cylindrical liner.

Another objective of this invention is the provision of a container system that is economical to produce, easy to use and repair, and reliable.

These and other objectives will be apparent from the drawings, as well as the description and claims which follow.

SUMMARY OF THE INVENTION

The present invention relates to a container for fluent material. The container includes a flexible liner for holding the fluent material, a plurality of substantially rigid vertical support walls spaced around the periphery of the liner, and a flexible skin interconnecting the walls and encircling the liner so as to laterally constrain and support it when fluent material is added.

The container can include a bottom wall under the liner and connected to some of the support walls. Furthermore, a top platform can be removably secured over the liner so as to rest on top of the support walls. This provides the strength and rigidity to make the container system stackable. The support walls can be removably disposed in pockets or a sleeve in the flexible skin.

The container system of this invention is flexible and lightweight. The container can be removably secured to a standard wooden pallet, and the resulting unit can be stacked for more efficient use of storage space. The unit easily breaks down, with the container being foldingly collapsible, even with the support walls in place.

In another embodiment of the container system of this invention, an eight-sided collapsible container is formed without using uninterrupted fully rigid walls on four of the eight sides. Instead, sixteen vertical seams join the inner and outer skins to form eight vertical pockets that extend substantially the full height of the container. Each of these pockets receives a rigid support member or slat and a top flap folds over the top of the pocket and the slat. When the slats are placed in alternating closely and widely spaced pairs of pockets as disclosed, essentially semi-rigid side walls are created between the closely spaced pockets and flexible side walls are created between the semi-rigid walls. This arrangement is easier to assemble and thereby less costly to produce, but nevertheless provides a securely hydrostabilized container.

DETAILED DESCRIPTION OF THE PREFERRED EMBODIMENT

Figure 1:
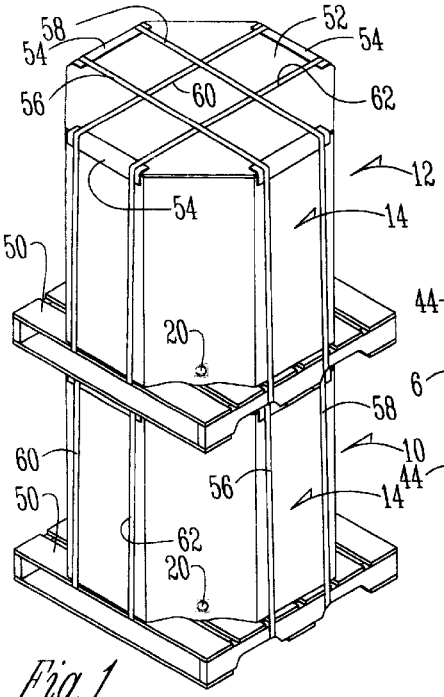
FIG. 1 is a perspective view of bulk container system of this invention.
Figure 2:
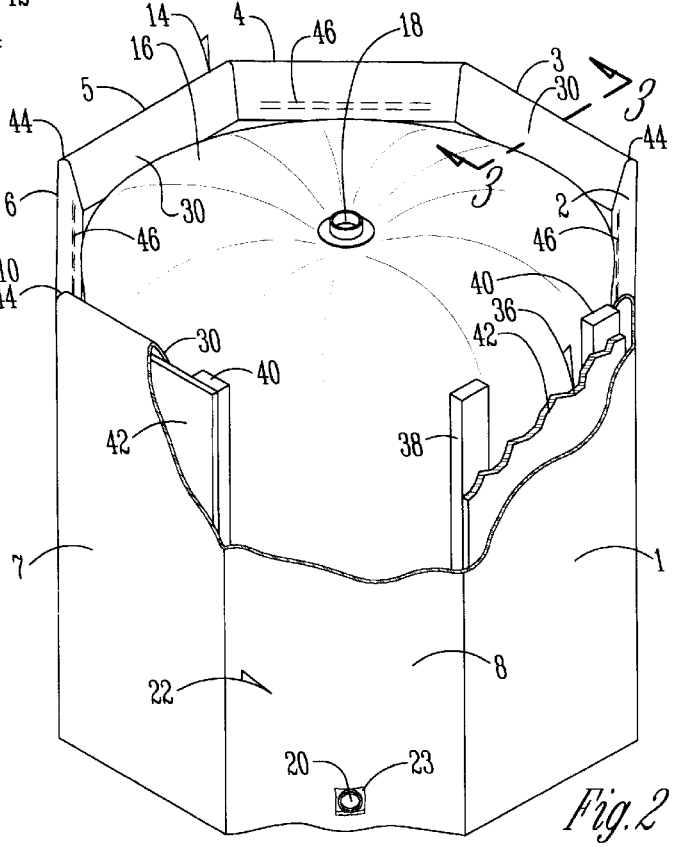
FIG. 2 is a perspective view illustrating the construction of the bottom container shown in FIG. 1. The other container (s) stacked thereon share the same common structure as shown in FIG. 2.
Figure 3:
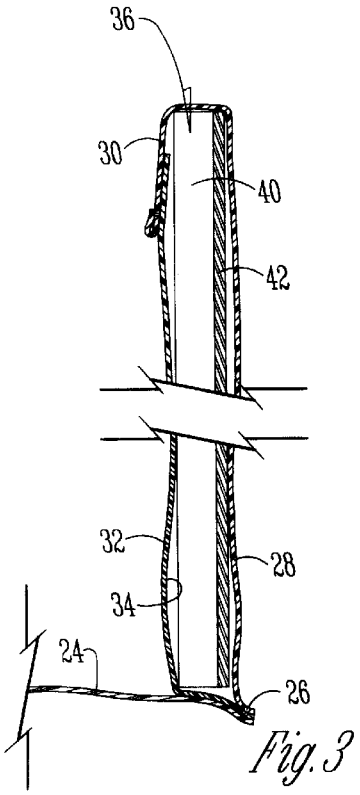
FIG. 3 is a sectional view of the outer body of the container taken along line 3—3 in FIG. 2.

FIG. 1 shows two container systems 10, 12 of this invention stacked on top of each other for storage or transport. FIG. 2 shows the construction of the container 14 which is the main component of the flexible stackable container system 10, 12. The container 14 includes a removable flexible liner 16 having an inlet opening with a top cap 18 and a drain or outlet opening with a threaded plug 20 therein. Of course, the liner 16 is empty when first inserted into the outer body skin 22. However, when filled it has a horizontal periphery. Polyethylene liners are known to perform well in holding nonhazardous fluent materials. As best seen in FIG. 3, the container 14 further includes a bottom 24 joined along a seam 26 with an outer skin 28. The outer skin 28 includes a top flap 30 which overlaps an inner skin 32 that is joined to the bottom 24 and the outer skin 28 along seam 26. This forms a sleeve with an upwardly directed opening therein 34 between the inner and outer skins 28, 32. In addition to the substantially horizontal seam 26, vertical seams can be added so that the sleeve 34 comprises a plurality of pockets. A woven "poly" fabric-like material such as polypropylene, polyethylene, polyvinylchloride, or the like, is preferred for the bottom 24, as well as for inner and outer skins 28, 32. At least the outer skin 28 should be coated to waterproof the skin so the container can be stored indoors or outdoors.

As shown in FIG. 2, a plurality of rigid support walls 36 are inserted into the sleeve 34 or pockets at spaced intervals circumferentially around the liner 16. The support walls 36 include a pair of horizontally spaced upright members 38, 40 and a substantially rigid wall member 42 which extends between the upright members 38, 40 and is attached to them. The wall member 42 and the upright members 38, 40 are made of wood, but other strong and lightweight materials could be used without detracting significantly from the invention. To store up to 100–400 gallons in the container, a one-quarter inch thick particle board wall member 42 and 2 inch by 4 inch wooden upright members 38, 40 will suffice.

In the preferred embodiment, an octagonal outer body skin 22 is formed around the liner 16 by inserting the support walls 36 into the sleeve 34 or pockets on the odd numbered sides 1, 3, 5 and 7. The flap 30 is folded over the support walls 36 until it overlaps the inner skin 32. Folds, seams or slits 44 are provided along the flap 30 to allow it to lay flat. The seams 44 may extend all the way to the bottom 24. Along the even-numbered flexible sides 2, 4, 6 and 8, the flap 30 can be secured to the inner skin 32 along a seam 46 by glue, stitching, or other suitable means of securement.

Figure 4:
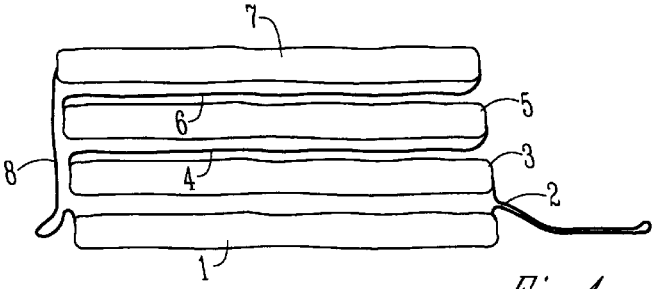
FIG. 4 is a front elevation view of the outer body of the container of FIG. 3 in a folded condition for storage or transport when the container is empty. The vertical spacing is exaggerated slightly to better show the flexible sides or sections interconnecting the support walls.

FIG. 4 illustrates that the container 14 can be collapsed when the liner 16 is empty or removed. The user merely folds the sides of the container 14 inwardly upon each other until the compact rectilinear structure shown results. This structure is compact, lightweight, and easily storable or transportable. Other methods of folding the container 14, with or without the rigid support walls being removed, are contemplated and would be obvious to those skilled in the art after studying the drawings and this description.

It is contemplated that the bottom 24 may not be necessary, as the container 14 can be placed on a sufficiently supportive pallet 50 prior to inserting and filling the liner 16.

As best seen in FIG. 1, a conventional wooden pallet 50 can be positioned in supporting or load bearing relation under the liner 16 of the container 14. Thus, the outer body skin 22 and the support walls 36 contained therein rest on the pallet 50. A substantially rigid top platform 52 is placed on top of the container 14. The platform 52 rests on at least some of the vertical support walls 36. Corner protectors 54 (preferably made of cardboard) mount on some edges of the platform 52 as shown, preferably over the support walls 36. Then the user can secure the top 52 to the container 14 and the container 14 to the pallet 50 with a plurality of flexible strapping bands 56, 58, 60 and 62. Once the bands 56–62 are tightened and locked, the container 14 and pallet 50 move as an integrated unit. Thus, the units can be stacked on top of each other as shown in FIG. 1. FIG. 1 shows the containers 10, 12 stacked two units high; however, it is possible that the units could be stacked even higher. It is important that the support walls 36 be positioned directly over each other for optimum results. The upright members 38, 40 carry the bulk of the compressive load. Advantageously, the force or pressure of the flowable material in the liner pushes outwardly with substantially equal force on all of the support walls 36. Thus, the filled liner 16 actually hydraulically stabilizes or "hydrostabilizes" the support walls 36, keeping them vertical and rigid for stacking purposes.

In use, the collapsed container 14 is unfolded from the storage position shown in FIG. 4. The container 14 is placed on a supporting surface, such as the pallet 50 and arranged in its octagonal configuration, as shown in FIG. 2. The empty liner 16 is placed inside the loop of the outer body skin 22 with the inlet opening or top cap 18 up and the drain opening plug 20 registered with the aperture 23 provided in the outer body skin 22. Next the user fills the liner 16 with the fluent material, then replaces the top cap 18. If the container 14 is to be stacked, the user will apply the top platform 52 and the bands 56–62, but these items are optional in non-stacking applications.

Of course, the width of the flexible sides 2, 4, 6 and 8 can be varied. However, the widths of sides 2, 4, 6 and 8 should be at least as great as the widths of the corresponding adjacent sides 1, 3, 5 and 7 to provide the greatest collapsibility. It is contemplated that one or two flexible sides of sufficient width would still allow the container sides to be folded and collapsed for more compact storage.

The bulk container of this invention efficiently stores and facilitates handling of nonhazardous liquids, including, but not limited to, tomato paste, purees, and concentrates. One person can assemble the container system in about a minute. The container is hydrostabilized so no horizontal banding is required. Furthermore, this container system weighs 70 percent less than similar conventional bins. This container system also saves freight costs whether the container is full or empty (broken down).

Figure 5:
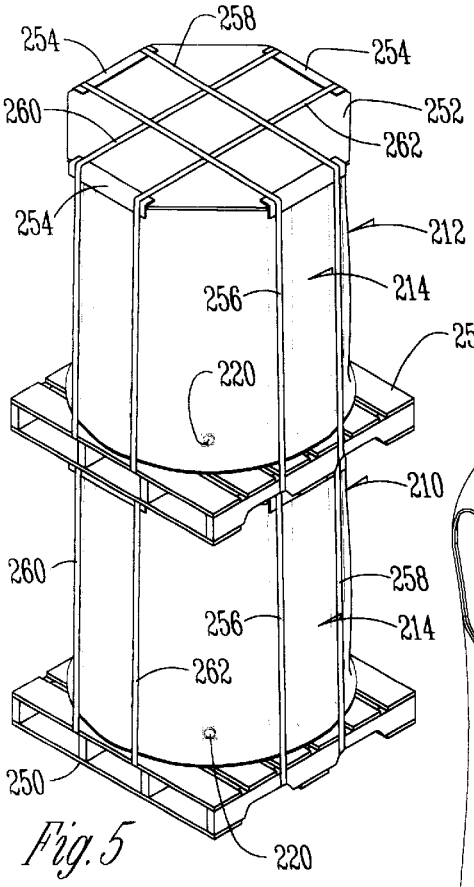
FIG. 5 is perspective view similar to FIG. 1 but shows another embodiment of the bulk container system of the present invention.
Figure 6:
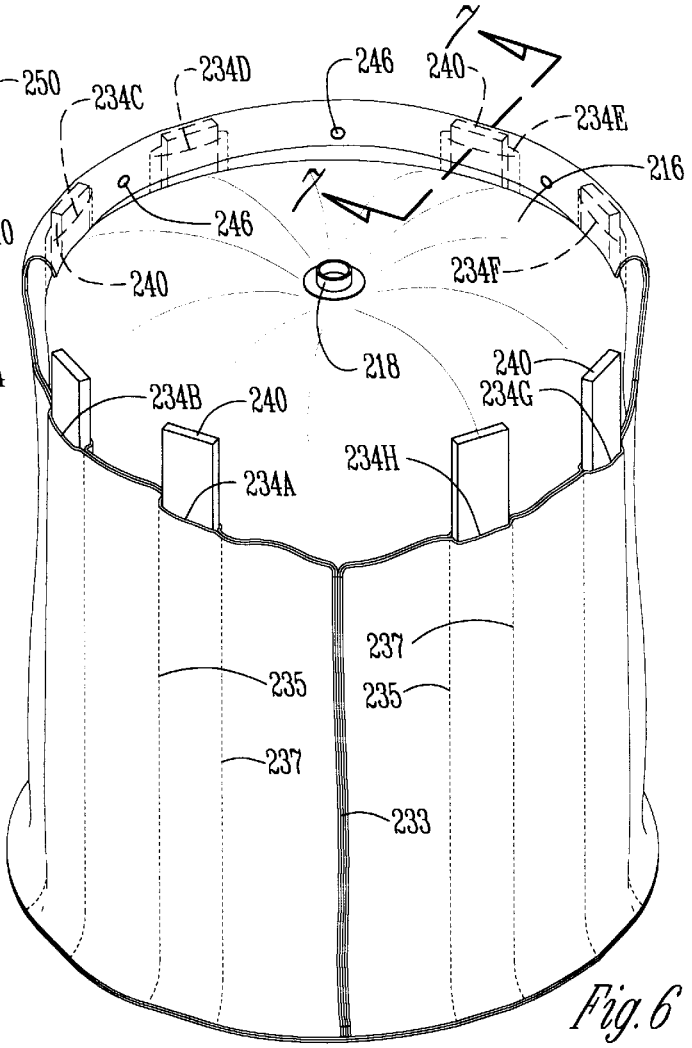
FIG. 6 is a perspective view of one of the containers shown in FIG. 5.
Figure 7:
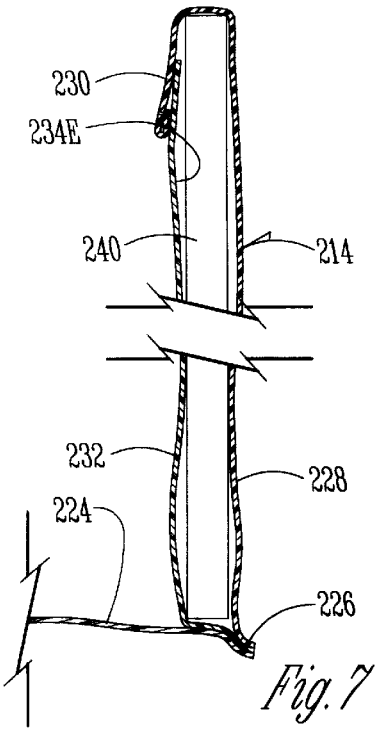
FIG. 7 is a cross sectional view of the container taken along line 7—7 in FIG. 6.

Another embodiment of the container system of this invention is shown in FIGS. 5–7. Features in FIGS. 5–7 that are analogous to features previously described above relative to FIGS. 1–4 have been given similar reference numerals. For example, a bottom container system 210 and a top container system 212 including containers 214 can be placed on individual pallet 250 and stacked on top of each other as shown in FIG. 5. The container 214 itself is best seen in FIG. 6. An optional flexible and preferably liquid-impermeable liner 216 with a top inlet opening a 218 can be placed inside the container 214. A rigid top platform or lid 252 (FIG. 5) can also be included for stacking purposes, but is not required. A drain or outlet opening 220 is included near the bottom of the container 214. The outlet opening 220 is in fluid communication with the inside of the liner 216 if a liner is used.

The container 214 has a flexible bottom skin 224 with a substantially round periphery. A seam 226 is formed where the bottom 224 is joined to a flexible outer tubular member 228 and an inner tubular member 232. The bottom skin 224 and the inner tubular member 232 have their inwardly directed surfaces coated with plastic so that they are still flexible but are impervious to moisture. The outer surface of the outer tubular member 228 is similarly coated. The preferred material for the container is a conventional 6.5-ounce tightly woven "poly" fabric-like material.

Preferably the outer tubular member 228 includes a flexible flap 230 that folds inwardly over the top of the inner tubular member 232. Of course, the flap 230 could be located on the inner tubular member and fold outwardly over the outer tubular member 228 without detracting from the present invention. When the flap 230 folds inwardly, it is preferable to have its hem hidden as shown to ensure that no sharp threads are left exposed to poke or abrade the liner 216. The outer tubular member 228 and the inner tubular member 232 are joined to each other along a generally vertical main side seam 233 that is centered on a non-pocket panel of the container. Like the hem of flap 230, the main side seam 233 and the bottom seam 226 are sewn so that they are directed away from the liner 216 to avoid possible punctures of the liner.

Furthermore, the outer member 228 and the inner member 232 are also joined together by sixteen circumferentially or horizontally spaced vertical seams 235, 237 to form a plurality of vertical pockets 234A, 234B, 234C ,234D, 234E, 234F, 234G, 234H (hereinafter 234 when referred to in general). For reasons that will be discussed in greater detail below, the seams 235, 237 extend substantially the entire height of the container 214. In other words, the seams 235, 237 start at the bottom seam 226 and terminate near the fold 230. The preferred spacing of the seams 235, 237 and thereby the pockets 234 is as shown in FIG. 6. Pockets 234A and 234B, 234C and 234D, 234E and 234F, and 234G and 234H are closely spaced in pairs, while the space between pockets 234B and 234C, 234D and 234E, 234F and 234G, and 234H and 234A is greater. Thus, the container is shaped like an irregular octagon having unequal adjacent sides but equal opposing sides.

It should be understood that the seams 226, 233, 235, 237 are sewn in the preferred embodiment, but the seams could also be formed by heat fusing or other conventional methods without detracting from the invention so long as the requisite strength is maintained at the seams.

Each of the pockets 234 slidably receives a narrow elongated rigid support member or slat 240, such as a wooden two-by-four. The slats 240 can be shorter than the depth of the pockets 234 so that there are no exposed portions of the slats protruding above the pockets 234 and contacting the liner 216, but this is not a strict requirement. In any event, the top flap 230 is large enough to fold in covering relation over the slats 240 and the openings at the top of the pockets 234 to prevent this undesirable contact between the liner 216 and the slats 240. The top flap 230 is preferably secured with fasteners 246 to the upper portion of inner member 232 between the pockets 234 around the perimeter of the container 214. The fastening means can permit detachable fastening, such as with Velcro™ strips, snaps and the like; or the fastening means can be permanent, such as with sewing, riveting and the like. If the top flap 230 is permanently fastened, the spacing of the fasteners 246 should be sufficient to allow a portion of the top flap 230 to be peeled back and the slats 240 inserted in their respective pockets.

The width of each of the pockets 234 is approximately the same as the width of the slat 240 SO the slat is snugly retained in the pocket once the container 214 is full. The seams 235, 237, and thus the pockets 234, also extend substantially the full height of the outer member 228 so that the slats cannot be skewed from their vertical positions.

Although the invention is not limited to a particular size of container, an example of one particular size will help one skilled in the art to better appreciate the features of the invention. When a round bottom skin 224 having a perimeter of approximately 144.5 inches and tubular members 228, 232 approximately 50 inches high are utilized, the container 214 will substantially cover a standard 48 inch by 48 inch square pallet 250. The vertical seams 235, 237 are sewn such that the pockets 234 are approximately six inches wide and are approximately nine inches apart from inside seam to inside seam for the closely spaced pairs and approximately fifteen inches apart from inside seam to inside seam for the widely spaced pairs. Preferably the effective pocket width is such that the slats 240 can be inserted without difficulty but are constrained laterally to so as to ensure that the slats will extend in a true vertical direction when the container is filled. The preferred spacing between the closely spaced pockets is between one to two times the width of the pocket, more preferably approximately 1.5 times the width of the pocket.

Thus, when the slats 240 are inserted into the pockets 234, substantially planar and semi-rigid walls approximately twenty-one inches wide are formed across the closely spaced pockets 234. Alternating between the semi-rigid walls are walls that are completely flexible in all directions and are approximately fifteen inches wide.

Due to the closely spaced pairs of pockets 234 and the slats 240 inserted therein, the semi-rigid walls formed therebetween are substantially rigid in a vertical direction, which facilitates stacking. However, the close spacing of the slats 240 also makes the semi-rigid walls substantially planar and imparts a substantial degree of horizontal rigidity and lateral stability to the panels between the closely spaced slats 240 in pocket pairs 234A and 234B, 234C and 234D, 234E and 234F, and 234G and 234H. This allows the rigid support wall 42 of the embodiment of FIGS. 1–4 to be omitted. Thus, fabrication of the container 214 is greatly simplified and streamlined when compared to the container 14. The result is a less costly container that still takes on a generally, albeit irregular, octagonal shape when filled. Because of its near circular net shape (the basic eight sided shape with alternating flexible and semi-rigid walls arranged in opposing pairs) the container 214 is advantageously hydrostabilized by its own shape and the hoop forces generated by the material filling the container 214, much the same as the container 14.

In use, the container 214 can be assembled by peeling back the flap 230 around the pockets 234 and inserting the slats 240. The user then covers the slats 240 and the pocket openings with the flap 230. Next the user positions the bottom skin 224 of the container 214 on the center of the pallet 250. While spreading the tubular members 228, 232 out in a radial direction the user inserts a liner 216, if one is to be used and it is not already in place. The user then fills the liner 216 through the top inlet opening 218. As the container 214 fills with flowable material, the hoop forces generated by the flowable material on the container automatically center or horizontally position the slats 240 within the pockets 234. The slats 240 become substantially vertical as the material is added to the container 214, and the walls or panels between the closely spaced slats 240 become semi-rigid while the flexible walls on either side of the semi-rigid panels become taut. The filled container 214 is therefore a robustly hydrostabilized unit whose shape is resistant to deformation from internal and external forces.

The lid 252, corner protectors 254, and strapping bands 256, 258, 260, 262 can be added to mount the container to the pallet 250 and to facilitate stacking.

Once the material has been drained from the container 214, the bottom skin 224 can be tucked inside the inner tubular member 232 and the container collapses radially, with or without removing the liner 216 and the slats 240. The resulting cylindrical bundle is compact, making it easy to store and transport.

One skilled in the art will appreciate that the bottom 224 can be omitted when a liner 216 is used. In that case, the liner 216 can be positioned within the inner tubular member 232 and can be directly supported by the pallet 250. The lower edges of the inner and outer members 232, 228 should still be joined to each other at a bottom peripheral seam 226 in this "bottomless" embodiment of the container.

Therefore, the present invention at least achieves its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A container for fluid material comprising:

a collapsible outer skin member comprising four opposing rigid vertical side walls arranged in perpendicular pairs and four flexible vertical side walls constructed of a flexible material, the flexible vertical side walls alternating with and being joined to the rigid side walls to define an octagonal open top;

the rigid side walls each including a pocket formed on the outer skin member and a rigid support wall slidably inserted into the pocket;

the pocket including an upwardly directed top opening;

and a removable liner for holding fluid material disposed inside the outer skin member, the liner having a top fill opening accessible through the octagonal open top of the container without moving the outer skin;

whereby the flexible side walls are made taut by fluid filling the liner such that the rigid support walls are held in place and the container is self-stabilizing during and after filling.

2. The container of claim 1 wherein the rigid support wall comprises a substantially planar plate member that has upper and lower edges completely disposed inside the pocket.

3. The container of claim 2 wherein a flexible pocket flap is attached to the outer skin member and folds in covering relation over the upper edge of the rigid support wall.

4. The container of claim 1 wherein the pocket is disposed between the outer skin member and the liner.

5. The container of claim 1 wherein the flexible side walls and the rigid support walls have a common width such that the octagonal open top has a regular octagonal perimeter.

6. The container of claim 1 where the outer skin member has a bottom wall interconnecting the rigid and flexible vertical side walls, the connection of the bottom wall and the rigid side walls defining the bottom seam of the pocket, the bottom wall being adapted to rest under the liner.

7. The container of claim 1 comprising a pallet positioned in load bearing relation under the liner and the rigid support walls.

8. The container of claim 7 wherein the pallet is removably secured to the rigid support walls by flexible strapping bands.

9. The container of claim 1 comprising a substantially rigid platform removable secured over the liner so as to rest on top of the rigid side walls.

10. The container of claim 1 wherein the outer skin member has an outer surface that is impervious to fluid materials.

11. The container of claim 1 wherein the liner has a lower portion with a sealable outlet opening formed therein and the one of the flexible side walls has an access aperture therein registered with the outlet opening.

12. The container of claim 1 wherein the outer skin member has a top flap thereon comprising a plurality of top flap portions each being registered with one of the support walls and being folded inwardly thereover to at least partially cover the upwardly directed top opening of the pocket and completely cover the respective support wall.

13. The container of claim 1 wherein the flexible vertical side walls are of sufficient width between the support walls such that, when the liner is empty, at least some of the flexible side walls fold completely across the support walls adjacent thereto and thereby the support walls fold toward each other and stackingly register with each other to form the collapsible outer skin member into a rectangular stack.

14. The container of claim 1 wherein the rigid support walls each comprise a substantially rigid plate member having vertical opposing planar surfaces and vertical sides edges, a first reinforcing bar member being attached to the one of the planar surfaces adjacent one of the side edges and a second reinforcing bar member being attached to said one of the planar surfaces adjacent to the other of the sides edges.

15. A bulk container for flowable materials comprising:

a bottom having a peripheral edge;

a flexible inner tubular member having an upper edge and a lower edge;

a flexible outer tubular member disposed outwardly adjacent the inner tubular member and having an upper edge, a lower edge, and a height defined between the upper and lower edge;

the lower edge of the outer member and the lower edge of the inner member being joined to the bottom adjacent the peripheral edge to define a bottom peripheral seam;

the inner tubular member and the outer tubular member being joined together along eight pairs of substantially parallel horizontally spaced vertical seams that extend substantially the full height of the outer tubular member and define four pairs of horizontally spaced vertically elongated pockets that oppose each other across the container, each pocket having a closed bottom, a top opening, and a width; and an elongated rigid slat having a fixed length and width and being slidably inserted longitudinally into each pocket through the top opening;

whereby the slats in the opposing pockets automatically give the container shape and dimensional stability as a result of hoop forces generated on the inner tubular member by the flowable material once the container is filled.

16. The container of claim 15 wherein the slat has an upper edge that protrudes from the pocket and the upper edge of the outer tubular member has a flexible flap attached thereto that folds over and covers the top opening of the pocket and the upper edge of the slat.

17. The container of claim 16 wherein the flexible flap is secured to the inner tubular member in at least one location between each of the pairs of pockets.

18. The container of claim 16 wherein the flexible flap is secured to the inner tubular member in at least one location between the respective individual pockets within the pairs of pockets.

19. The container of claim 15 wherein the slat has a length over width ratio of at least four.

20. The container of claim 15 wherein the bottom of the container is formed by a round substantially horizontal flexible skin.

21. The container of claim 15 wherein the bottom of the pocket is formed by the bottom peripheral seam.

22. The container of claim 15 comprising a removable moisture impervious liner resting on the bottom and being disposed inwardly adjacent to the inner tubular member.

23. The container of claim 15 wherein the inner tubular member and the outer tubular member are sewn together at the bottom peripheral seam.

24. The container of claim 15 wherein respective individual pockets within each pair of pockets are spaced apart a first distance and each pair of pockets is spaced a second distance from an adjacent pair of pockets, the first distance being less than the second distance.

25. The container of claim 24 wherein the first distance is between one to two times the width of the pocket.

26. The container of claim 24 wherein the first distance is approximately 1.5 times the width of the pocket.

27. The container of claim 15 wherein the width of the pocket is approximately the same as the width of the slat so that the slat fits in the pocket and is restrained against lateral movement within the pocket.

28. The container of claim 15 comprising a removable top that rests on and is supported by at least some of the slats.

29. A bulk container for flowable materials comprising:

a flexible inner tubular member having an upper edge and a lower edge;

a flexible outer tubular member disposed outwardly adjacent the inner tubular member and having an upper edge, a lower edge, and a height defined between the upper and lower edge;

the lower edge of the outer member and the lower edge of the inner member being joined together to define a bottom peripheral seam;

the inner tubular member and the outer tubular member being joined together along eight pairs of substantially parallel horizontally spaced vertical seams that extend substantially the full height of the outer tubular member and define four pairs of horizontally spaced vertically elongated pockets that oppose each other across the container, each pocket having a closed bottom, a top opening, and a width; and an elongated rigid slat having a fixed length and width and being slidably inserted longitudinally into each pocket;

a removable moisture impervious liner disposed inwardly adjacent to the inner tubular member and supported by a substantially horizontal planar support surface that also supports the slats;

whereby the slats in the opposing pockets automatically give the container shape and dimensional stability as a result of hoop forces generated on the inner tubular member by the flowable material once the container is filled.

30. A bulk container for flowable materials comprising:

an outer flexible skin member extending horizontally in a closed loop to form a polygon with more than four sides;

at least two pairs of directly opposing and circumferentially spaced pockets connected to and extending vertically alongside the outer skin member, the pockets each including an upwardly directed top opening and a closed lower end; and a plurality of rigid support members, one of the support members being slidably inserted into each of the pockets to provide both vertical and horizontal rigidity to the container when the container is filled;

the outer flexible skin having flexible portions that alternate circumferentially with the pockets having support members inserted therein.

* * * * *

UNITED STATES PATENT AND TRADEMARK OFFICE

CERTIFICATE OF CORRECTION

PATENT NO. : 6,164,453
DATED : December 26, 2000
INVENTOR(S) : Perkins, David W.

It is certified that error appears in the above-identified patent and that said Letters Patent is hereby corrected as shown below:

Title page,
Under the References Cited insert -- 5,158,369 10/1992 Derby. --

Claim 9, column 7,
Line 66, please replace "removable" with -- removably --.

Claim 14, column 8,
Line 23, please replace "sides" with -- side --.
Line 27, please replace "sides" with -- side --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*